US009883289B2

(12) United States Patent
Kushima et al.

(10) Patent No.: US 9,883,289 B2
(45) Date of Patent: Jan. 30, 2018

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Noriyuki Kushima, Kirishima (JP); Shuichi Fukuoka, Kirishima (JP); Takeshi Hirayama, Kirishima (JP); Kenji Yamakawa, Kirishima (JP); Hiroshi Ninomiya, Kirishima (JP)

(73) Assignee: Kyocera Corporation, Kyoto (JP)

( * ) Notice: Subject to any disclaimer, the term of this patent is extended or adjusted under 35 U.S.C. 154(b) by 18 days.

(21) Appl. No.: 14/410,722

(22) PCT Filed: Jul. 30, 2013

(86) PCT No.: PCT/JP2013/070641
§ 371 (c)(1),
(2) Date: Dec. 23, 2014

(87) PCT Pub. No.: WO2014/024736
PCT Pub. Date: Feb. 13, 2014

(65) Prior Publication Data

US 2015/0326976 A1 Nov. 12, 2015

(30) Foreign Application Priority Data

Aug. 10, 2012 (JP) ..... 2012-179063

(51) Int. Cl.
*H04R 25/00* (2006.01)
*H04R 7/04* (2006.01)
(Continued)

(52) U.S. Cl.
CPC ..... *H04R 7/045* (2013.01); *H04R 7/04* (2013.01); *H04R 17/00* (2013.01); *H04R 1/227* (2013.01); *H04R 1/26* (2013.01); *H04R 2440/05* (2013.01)

(58) Field of Classification Search
CPC . H04R 7/04; H04R 7/05; H04R 9/063; H04R 2440/05
See application file for complete search history.

(56) References Cited

U.S. PATENT DOCUMENTS 4,751,419 A * 6/1988 Takahata ..... H04R 1/227 310/322
4,985,926 A * 1/1991 Foster ..... H04R 17/00 310/366
(Continued)

FOREIGN PATENT DOCUMENTS

CN 101313628 A 11/2008
JP 2003-500915 A 1/2003
(Continued)

OTHER PUBLICATIONS

Chinese Office Action with English concise explanation, Chinese Patent Application No. 201380029597.6, dated Aug. 18, 2017, 7 pgs.
(Continued)

*Primary Examiner* — Curtis Kuntz
*Assistant Examiner* — Ryan Robinson
(74) *Attorney, Agent, or Firm* — Volpe and Koenig, P.C.

(57) ABSTRACT

An acoustic generator according to an embodiment includes at least a plurality of piezoelectric elements (exciters) and a vibrating portion. The piezoelectric elements vibrate upon reception of input of an electric signal. The piezoelectric elements are attached to the vibrating portion. The piezoelectric elements are attached to the vibrating portion asymmetrically with respect to all the symmetry axes of a figure
(Continued)

drawn by a contour of the vibrating portion when seen from the above.

13 Claims, 7 Drawing Sheets

(51) Int. Cl.

| | |
|---|---|
| ***H04R 17/00*** | (2006.01) |
| *H04R 1/22* | (2006.01) |
| *H04R 1/26* | (2006.01) |

(56) References Cited

U.S. PATENT DOCUMENTS

| | | | | |
|---|---|---|---|---|
| 6,377,695 | B1 * | 4/2002 | Azima | B60R 11/0217 381/152 |
| 6,519,347 | B1 * | 2/2003 | Morecroft | H04R 9/066 381/152 |
| 6,522,760 | B2 * | 2/2003 | Azima | H04R 7/045 381/431 |
| 6,554,098 | B1 * | 4/2003 | Komura | H04R 1/02 181/173 |
| 6,676,879 | B1 * | 1/2004 | Azima | B60R 11/0223 264/319 |
| 6,965,678 | B2 * | 11/2005 | Bank | G06F 1/1616 381/152 |
| 7,194,098 | B2 * | 3/2007 | Azima | H04R 7/045 381/152 |
| 7,236,601 | B1 * | 6/2007 | Bachmann | H04R 7/045 381/152 |
| 8,391,540 | B2 * | 3/2013 | Berriman | H04R 7/045 381/431 |
| 8,897,469 | B2 * | 11/2014 | Yu | H04R 7/045 381/152 |
| 2002/0021812 | A1 * | 2/2002 | Bank | H04R 7/045 381/152 |
| 2008/0218031 | A1 | 9/2008 | Kuroda et al. | |
| 2009/0136077 | A1 | 5/2009 | Suzuki et al. | |
| 2014/0314255 | A1 | 10/2014 | Fukuoka et al. | |

FOREIGN PATENT DOCUMENTS

| | | | | |
|---|---|---|---|---|
| JP | 2009-130663 | A | 6/2009 | |
| JP | 2012-110018 | A | 6/2012 | |
| WO | WO 0033612 | A2 * | 6/2000 | H04R 1/227 |
| WO | 00/70909 | A2 | 11/2000 | |
| WO | 2010/106736 | A1 | 9/2010 | |

OTHER PUBLICATIONS

Japanese Office Action with English concise explanation, Japanese Patent Application No. 2014-529438, dated Jul. 27, 2016, 3 pgs.
International Search Report, PCT/JP2013/070641, dated Sep. 30, 2013, 1 pg.

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/GT2013/070641, filed on Jul. 30, 2013, which designates the United States, incorporated herein by reference, and which claims the benefit of priority from Japanese Patent Application No. 2012-179063, filed Aug. 10, 2012, the entire contents of which are incorporated herein by reference.

FIELD

The disclosed embodiments relate to an acoustic generator, an acoustic generation device, and an electronic device.

BACKGROUND

Conventionally, acoustic generators using an actuator have been known (for example, see Patent Literature 1). The acoustic generators output sound by applying a voltage to the actuator attached to a vibrating plate and vibrating the actuator to vibrate the vibrating plate.

CITATION LIST

Patent Literature

Patent Literature 1: Japanese Patent Application Laid-open No. 2009-130663

SUMMARY

Technical Problem

The above-mentioned conventional acoustic generators have the following problem. That is, peaks (portions having sound pressure higher than the periphery) and dips (portions having sound pressure lower than the periphery) are easy to be generated in frequency characteristics of the sound pressure because resonance of the vibrating plate is used positively and it is difficult to provide preferable sound quality.

Solution to Problem

An acoustic generator according to an embodiment includes at least a plurality of exciters and a vibrating portion. The exciters vibrate upon reception of input of an electric signal. The exciters are attached to the vibrating portion. The exciters are attached to the vibrating portion asymmetrically with respect to all the symmetry axes of a figure drawn by a contour of the vibrating portion when seen from the above.

DESCRIPTION OF EMBODIMENTS

Hereinafter, embodiments of an acoustic generator, an acoustic generation device, and an electronic device that are disclosed by the present application will be described in detail with reference to the accompanying drawings. It should be noted that the embodiments as will be described below do not limit the invention.

First Embodiment

Figure 1A:
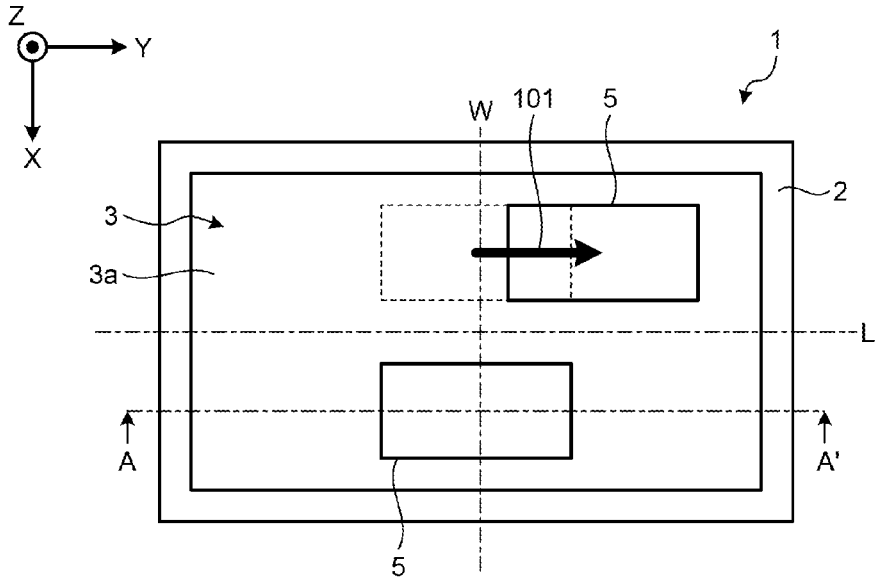
FIG. 1A is a plan view schematically illustrating an acoustic generator according to a first embodiment.
Figure 1B:
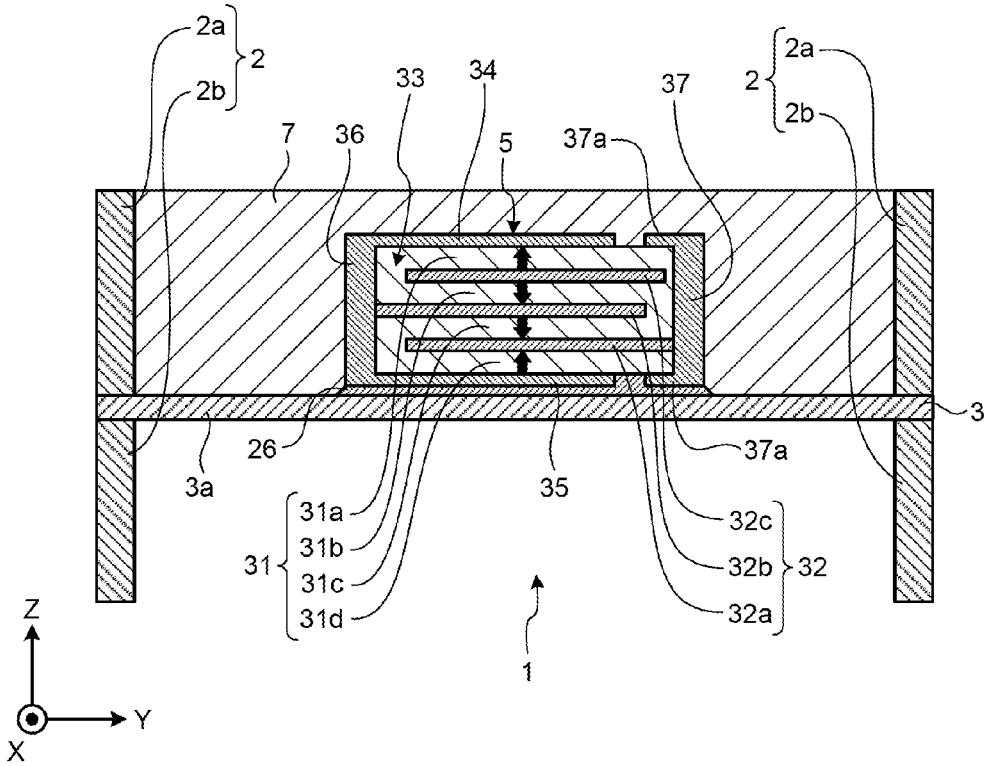
FIG. 1B is a cross-sectional view cut along line A-A' in FIG. 1A.

First of all, the configuration of an acoustic generator according to a first embodiment will be described with reference to FIG. 1A and FIG. 1B. FIG. 1A is a plan view schematically illustrating the configuration of an acoustic generator 1 in the embodiment. FIG. 1B is a cross-sectional view cut along line A-A' in FIG. 1A.

For convenience of clear explanation, FIG. 1A and FIG. 1B illustrate a three-dimensional orthogonal coordinate system. In FIG. 1A, illustration of a resin layer 7 is omitted. The orthogonal coordinate system is also illustrated in other drawings that are used for the following description in some cases.

FIG. 1B illustrates the acoustic generator 1 in an enlarged manner in the Z-axis direction for convenience of clear explanation.

As illustrated in FIG. 1A, the acoustic generator 1 in the embodiment includes a frame 2, a vibrating plate 3, a plurality of piezoelectric elements 5, and the resin layer 7.

Although the case where the acoustic generator 1 includes two piezoelectric elements 5 as illustrated in FIG. 1A is described mainly in the embodiment, it is sufficient that the plurality of piezoelectric elements 5 are provided and equal to or more than three piezoelectric elements 5 may be provided. In the embodiment, description is made while the two piezoelectric elements 5 have the same shape unless otherwise expressly noted.

The frame 2 is configured by two frame members 2*a* and 2*b* having the same rectangular frame shape. The frame 2 functions as a supporting body that holds a peripheral edge portion of the vibrating plate 3 between the two frame members 2*a* and 2*b* to support the vibrating plate 3. The thickness and a material of the frame 2 are not particularly limited. Various materials such as metal and resin can be used to form the frame 2. For example, the frame 2 made of stainless having the thickness of approximately 100 to 1000 μm can be preferably used because it is excellent in mechanical strength and corrosion resistance.

The vibrating plate 3 has a film-like shape and the peripheral edge portion thereof is sandwiched by the frame 2 to be fixed in a state where a tensile force is applied to the vibrating plate 3. A portion of the vibrating plate 3 at the inner side of the frame 2, that is, a portion of the vibrating plate 3 that is not sandwiched by the frame 2 and can vibrate freely is assumed to be a vibrating portion 3*a*. Accordingly, the vibrating portion 3*a* corresponds to a portion having a substantially rectangular shape at the inner side of the frame 2 and is provided at the inner side of the frame 2 so as to vibrate.

The vibrating plate 3 can be made of various materials such as resin and metal. For example, the vibrating plate 3 can be configured by a resin film made of polyethylene and polyimide having the thickness of approximately 10 to 200 μm. When the vibrating plate 3 has sufficient rigidity, the frame 2 may not be provided.

The plurality of piezoelectric elements 5 are attached to the surface of the vibrating portion 3*a* and function as exciters exciting the vibrating portion 3*a* when they receive application of a voltage and vibrate. The upper and lower main surfaces of the piezoelectric element 5 have rectangular plate-like shapes. The piezoelectric element 5 includes a laminate body 33, surface electrode layers 34 and 35, and first to third external electrodes. The laminate body 33 is formed by alternately laminating four piezoelectric layers 31 (31*a*, 31*b*, 31*c*, 31*d*) and three internal electrode layers 32 (32*a*, 32*b*, 32*c*). The surface electrode layers 34 and 35 are formed on the upper and lower surfaces of the laminate body 33, respectively. The first to third external electrodes are provided on end portions of the laminate body 33 in the lengthwise direction (Y-axis direction).

This first external electrode 36 is arranged on an end portion of the laminate body 33 in the −Y direction and is connected to the surface electrode layers 34 and 35 and the internal electrode layer 32*b*. This second external electrode 37 and this third external electrode (not illustrated) are arranged on an end portion of the laminate body 33 in the +Y direction with an interval therebetween in the X-axis direction. The second external electrode 37 is connected to the internal electrode layer 32*a* and the third external electrode (not illustrated) is connected to the internal electrode layer 32*c*.

Upper and lower end portions of the second external electrode 37 extend to the upper and lower surfaces of the laminate body 33 and folded external electrodes 37*a* are formed thereon. These folded external electrodes 37*a* are provided to extend so as to be spaced from the surface electrode layers 34 and 35 by predetermined distances such that they do not make contact with the surface electrode layers 34 and 35 formed on the surfaces of the laminate body 33. In the same manner, upper and lower end portions of the third external electrode (not illustrated) extend to the upper and lower surfaces of the laminate body 33 and folded external electrodes (not illustrated) are formed thereon. These folded external electrodes (not illustrated) are provided to extend so as to be spaced from the surface electrode layers 34 and 35 by predetermined distances such that they do not make contact with the surface electrode layers 34 and 35 formed on the surfaces of the laminate body 33.

The piezoelectric layers 31 (31*a*, 31*b*, 31*c*, 31*d*) are polarized in the directions as indicated by arrows in FIG. 1B. A voltage is applied to the first external electrode 36, the second external electrode 37, and the third external electrode such that the piezoelectric layers 31*c* and 31*d* expand when the piezoelectric layers 31*a* and 31*b* contract and the piezoelectric layers 31*c* and 31*d* contract when the piezoelectric layers 31*a* and 31*b* expand. Thus, the piezoelectric element 5 is a bimorph-type piezoelectric element, and bends and vibrates in the Z-axis direction such that amplitude thereof changes in the Y-axis direction when an electric signal is input thereto. One end of a wiring conductor (not illustrated) is connected to the first external electrode 36, the second external electrode 37, and the third external electrode and the other end of the wiring conductor (not illustrated) is drawn out to the outside of the resin layer 7. An electric signal is input to the first external electrode 36, the second external electrode 37, and the third external electrode through the wiring conductor.

Existing piezoelectric ceramics such as lead zirconate (PZ), lead zirconium titanate (PZT), Bi-layered compound, and a lead-free piezoelectric material like a tungsten bronze structure compound can be used as the piezoelectric layers 31. The thicknesses of the piezoelectric layers 31 can be set appropriately in accordance with desired vibration characteristics. For example, the thicknesses of the piezoelectric layers 31 can be set to 10 to 100 μm from a viewpoint of driving at a low voltage.

The internal electrode layers 32 can be made of various existing conductive materials. For example, the internal electrode layers 32 can contain a metal component made of silver and palladium and a material component forming the piezoelectric layers 31. The internal electrode layers 32 contain the ceramic component forming the piezoelectric layers 31, so that stress due to difference in the thermal expansion between the piezoelectric layers 31 and the internal electrode layers 32 can be reduced. The internal electrode layers 32 may not contain the metal component made of silver and palladium or may not contain the material component forming the piezoelectric layers 31.

The surface electrode layers 34 and 35 and the first to third external electrodes can be made of various existing conductive materials. For example, they can contain a metal component made of silver and a glass component. Thus, the surface electrode layers 34 and 35 and the first to third external electrodes contain the glass component, so that strong adhesion force can be provided between the surface electrode layers 34 and 35 and the first to third external electrode and the piezoelectric layers 31 and the internal electrode layers 32. Note that they are not limited to contain the glass component.

Furthermore, the main surface of the piezoelectric element 5 at the vibrating portion 3*a* side is bonded to the vibrating portion 3*a* with an adhesive layer 26. The thickness of the adhesive layer 26 is desirably equal to or smaller than 20 μm, more desirably equal to or smaller than 10 μm. When the thickness of the adhesive layer 26 is equal to or smaller than 20 μm, vibration of the laminate body 33 is easy to be transmitted to the vibrating portion 3*a*.

Well known adhesives such as epoxy-based resin, silicon resin, and polyester-based resin can be used as an adhesive for forming the adhesive layer 26. As a method of curing the resin that is used as the adhesive, any method of thermal curing, photo-curing, and anaerobic curing may be used.

Furthermore, in the acoustic generator 1 in the embodiment, a cover layer formed by the resin layer 7 covers at least a part of the surface of the vibrating portion 3*a*. To be specific, in the acoustic generator 1 in the embodiment, a resin is filled at the inner side of the frame member 2*a* so as to embed therein the vibrating portion 3*a* and the piezoelectric element 5, and the resin layer 7 is formed by the filled resin.

The resin layer 7 can be formed by epoxy-based resin, acryl-based resin, silicon-based resin, rubber, or the like. In consideration of reduction of the peaks and the dips, the resin layer 7 preferably covers the piezoelectric element 5 completely but may not cover the piezoelectric element 5 completely. Furthermore, the resin layer 7 may not necessarily cover the entire vibrating portion 3*a* and the resin layer 7 may be provided so as to cover a part of the vibrating portion 3*a* depending on cases. The thickness of the resin layer 7 can be appropriately set, for example, is set to approximately 0.1 mm to 1 mm. The resin layer 7 may not be provided depending on cases.

Thus, resonance of the vibrating portion 3*a* can be moderately damped by providing the resin layer 7 as described above. This can reduce the peaks and the dips in the frequency characteristics of the sound pressure that are generated due to the resonance phenomenon to be small, thereby reducing frequency-related variation of the sound pressure.

In the acoustic generator 1 in the embodiment, the plurality of exciters (piezoelectric elements 5) are attached to the vibrating portion 3*a* asymmetrically with respect to all the symmetry axes of a figure drawn by a contour of the vibrating portion 3*a* (figure drawn by an inner-side contour of the frame 2) when the acoustic generator 1 is seen from the above along the direction (Z-axis direction in the drawings) perpendicular to the main surface of the vibrating portion 3*a*. When the acoustic generator 1 (including the frame 2, the vibrating portion 3*a*, and the piezoelectric elements 5) is seen from the above, it is seen from the above along the thickness direction (direction perpendicular to the main surface of the vibrating portion 3*a*, Z-axis direction in the drawings) of the vibrating portion 3*a* unless otherwise described.

In the example as illustrated in FIG. 1A, the figure drawn by the contour of the vibrating portion 3*a* is a rectangular shape when seen from the above and it has two symmetry axes of a symmetry axis L parallel with the lengthwise direction (Y-axis direction) and a symmetry axis W parallel with the width direction (X-axis direction). One of the two piezoelectric elements 5 is arranged at a position deviated in the direction as indicated by an arrow 101 in FIG. 1A along the symmetry axis L from a position as indicated by a dashed-line rectangle. With this arrangement, the plurality of piezoelectric elements 5 are attached to the vibrating portion 3*a* asymmetrically with respect to the two symmetry axes (symmetry axis L and symmetry axis W) of the vibrating portion 3*a*. In the specification, the "symmetry axes of the vibrating portion 3*a*" indicate symmetry axes of the figure drawn by the contour of the vibrating portion 3*a* when seen from the above.

In this manner, the plurality of exciters (piezoelectric elements 5) are attached to the vibrating portion 3*a* asymmetrically with respect to the symmetry axes of the vibrating portion 3*a* so as to lower symmetric property of a composite vibrating portion configured by the vibrating portion 3*a* and the plurality of piezoelectric elements 5 that vibrate integrally. This lowering of the symmetric property eliminates degeneracy of resonance modes in vibration of the composite vibrating portion so as to disperse resonance peaks in the frequency characteristics of the sound pressure. Heights of the resonance peaks can be, therefore, reduced in the frequency characteristics of the sound pressure while enlarging widths of the peaks, thereby providing the acoustic generator 1 capable of generating high-quality sound having more flattened and excellent frequency characteristics of the sound pressure with small variation in the sound pressure. The degree of the deviation of the positions of the piezoelectric elements 5 from a symmetrical state with respect to the symmetry axes can be set appropriately in accordance with a desired effect level. For example, although a reasonable effect can be provided even when the positions of the piezoelectric elements 5 are deviated from each other by approximately 0.5 mm, the positions of the piezoelectric elements 5 are desirably deviated from each other by equal to or larger than approximately 5 mm when an effect to some extent is desired. When a large effect is desired, the positions of the piezoelectric elements 5 are desirably deviated from each other by equal to or larger than approximately 10 mm.

Figure 2A:
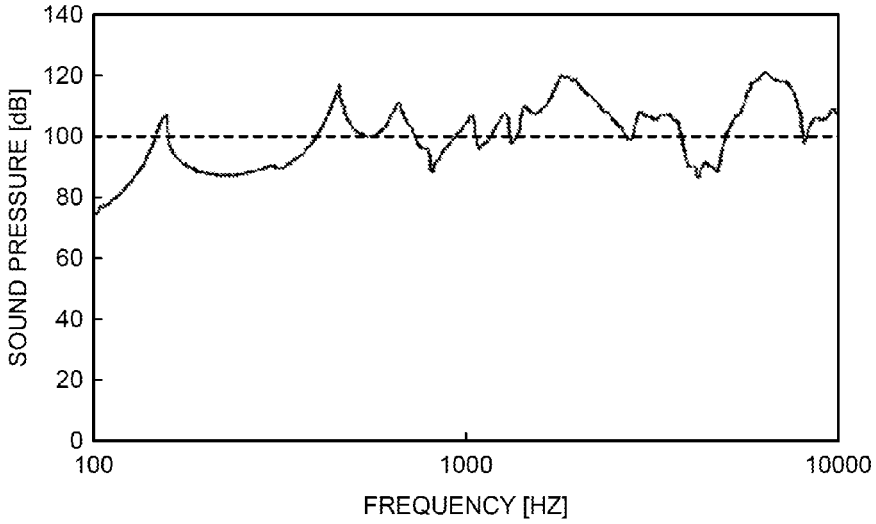
FIG. 2A is a (first) graph illustrating frequency characteristics of sound pressure.
Figure 2B:
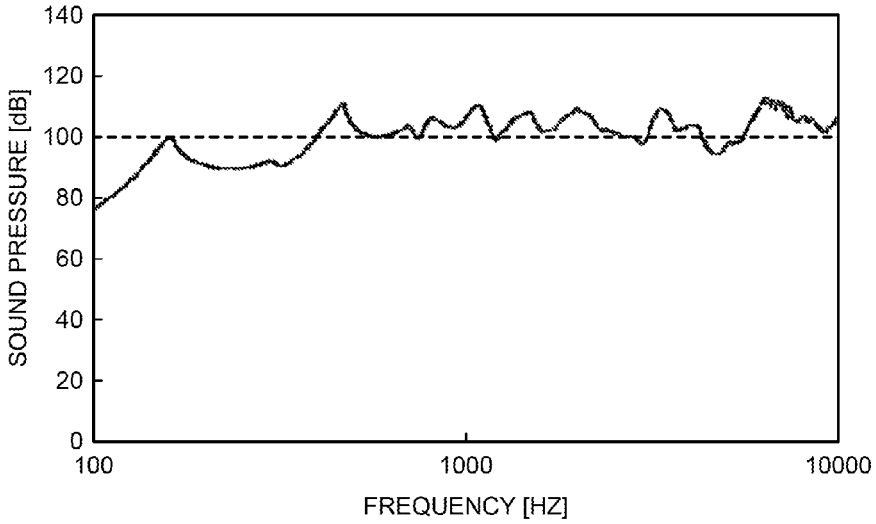
FIG. 2B is a (second) graph illustrating frequency characteristics of sound pressure.

This point will be described with reference to FIG. 2A and FIG. 2B. FIG. 2A and FIG. 2B are graphs illustrating frequency characteristics of the sound pressure. FIG. 2A illustrates the frequency characteristics of the sound pressure in a state where the symmetric property of the composite vibrating portion configured by the vibrating portion 3*a* and the plurality of piezoelectric elements 5 is high (one of the piezoelectric elements 5 is located at the position as indicated by the dashed-line rectangle in FIG. 1A). FIG. 2B illustrates the frequency characteristics of the sound pressure in a state where the symmetric property of the composite vibrating portion configured by the vibrating portion 3*a* and the plurality of piezoelectric elements 5 is low (state after one of the piezoelectric elements 5 is moved in the direction as indicated by the arrow 101 in FIG. 1A).

In the state where the symmetric property of the composite vibrating portion configured by the vibrating portion 3*a* and the plurality of piezoelectric elements 5 is high, degeneracy of a plurality of vibration modes is generated in the composite vibrating portion configured by the vibrating portion 3*a* and the plurality of piezoelectric elements 5 and large and steep peaks and dips are easy to be generated in the frequency characteristics of the sound pressure as illustrated in FIG. 2A.

On the other hand, in the state where the symmetric property of the composite vibrating portion configured by the vibrating portion 3*a* and the plurality of piezoelectric elements 5 is low, degeneracy of the plurality of vibration modes is eliminated and the peaks and the clips are reduced in the frequency characteristics of the sound pressure as illustrated in FIG. 2B. Thus, preferable frequency characteristics of the sound pressure with small variation in the sound pressure can be provided. In particular, midrange frequency characteristics of the sound pressure can be close to be flat, thereby providing preferable sound quality.

Next, an example of a method of manufacturing the acoustic generator 1 in the embodiment will be described. The piezoelectric element 5 is prepared initially. First of all, a binder, a dispersant, a plasticizer, and a solvent are kneaded into powder of a piezoelectric material so as to produce slurry. As the piezoelectric material, any of lead-based and lead-free materials can be used.

Subsequently, a green sheet is produced by shaping the slurry into a sheet form. Then, conductive pastes are printed on the green sheet so as to form a conductive pattern serving as the internal electrode. Three green sheets on which the electrode patterns are formed are laminated on one another and a green sheet on which the electrode pattern is not printed is laminated thereon so as to produce a laminate molded body. Then, the laminate molded body is decreased, sintered, and cut to have a predetermined dimension so as to provide the laminate body 33.

Thereafter, the outer peripheral portion of the laminate body 33 is processed if necessary. Conductive pastes for forming the surface electrode layers 34 and 35 are printed on both the main surfaces of the laminate body 33 in the laminate direction. Subsequently, conductive pastes for forming the first to third external electrodes are printed on both the end surfaces of the laminate body 33 in the lengthwise direction (Y-axis direction). Then, the electrodes are baked at a predetermined temperature.

Subsequently, in order to give piezoelectric property to the piezoelectric elements 5, a direct-current voltage is applied thereto through the first to third external electrodes so as to polarize the piezoelectric layers 31 of the piezoelectric elements 5. The DC voltage is applied such that the polarization is performed in the directions as indicated by the arrows in FIG. 1B. In this manner, the piezoelectric elements 5 as illustrated in FIG. 1A and FIG. 1B can be provided.

Subsequently, the vibrating plate 3 is prepared and the outer peripheral portion of the vibrating plate 3 is interposed between the frame members 2*a* and 2*b* forming the frame 2 and is fixed in a state where a tensile force is applied to the vibrating plate 3. Thereafter, the adhesive forming the adhesive layer 26 is applied onto the vibrating plate 3. The piezoelectric elements 5 at the surface electrode layer 35 side are pressed against the vibrating plate 3. Then, the adhesive is cured by irradiating it with heat or ultraviolet rays. The resin before cured is made to flow to the inner side of the frame member 2*a* and is cured so as to form the resin layer 7. In this manner, the acoustic generator 1 in the embodiment can be manufactured.

Other examples of arrangement of the piezoelectric elements 5 in the acoustic generator 1 in the embodiment will be sequentially described with reference to FIG. 3 to FIG. 6B. In FIG. 3 to FIG. 6B, as in FIG. 1A, the respective members of the acoustic generator 1 including the piezoelectric elements 5 are illustrated in a very simplified manner and illustration of the resin layer 7 is omitted. In FIG. 3 to FIG. 6B, only portions different from FIG. 1A are explained, and the same reference numerals denote the same constituent components and overlapped description thereof is omitted. In FIG. 3 to FIG. 6B, the figure drawn by the contour of the vibrating portion 3*a* is substantially rectangular when seen from the above and it has two symmetry axes of the symmetry axis L parallel with the lengthwise direction (Y-axis direction) and the symmetry axis W parallel with the width direction (X-axis direction) as in the case of FIG. 1A.

Figure 3:
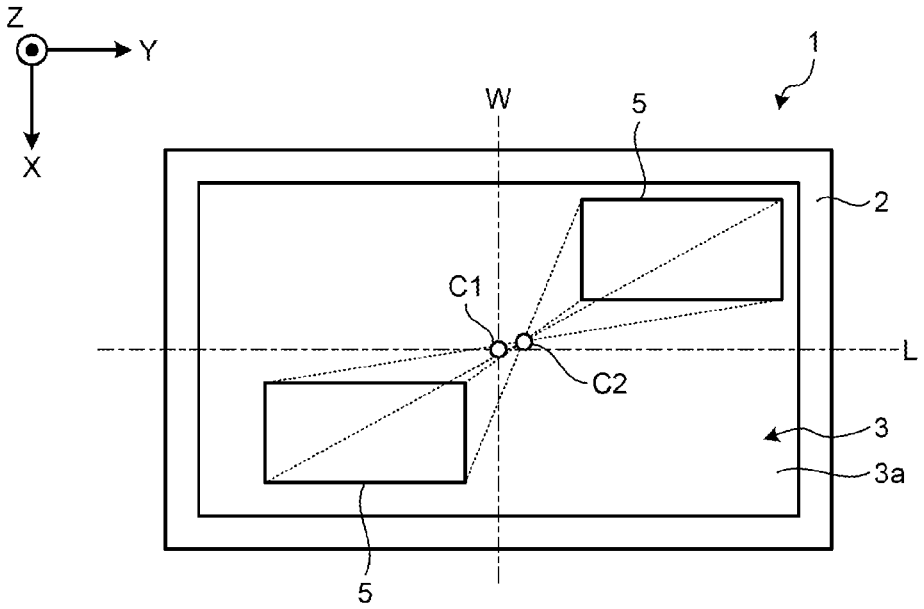
FIG. 3 is a (first) plan view schematically illustrating an example of arrangement of piezoelectric elements.

FIG. 3 is a (first) plan view schematically illustrating an example of arrangement of the piezoelectric elements 5 in the acoustic generator 1 in the embodiment. In the example as illustrated in FIG. 3, the piezoelectric elements 5 are arranged such that a center of symmetry (symmetric point) C2 of a two-dimensional figure formed by the two piezoelectric elements 5 is deviated from a centroid C1 (intersection of the symmetry axis L and the symmetry axis W, symmetric point of the vibrating portion 3*a*) of the vibrating portion 3*a*. Thus, the plurality of piezoelectric elements 5 are attached to the vibrating portion 3*a* asymmetrically with respect to the two symmetry axes L and W and the centroid C1 of the figure drawn by the contour of the vibrating portion 3*a* when the vibrating portion 3*a* is seen from the above. This arrangement of the piezoelectric elements 5 also lowers symmetric property of the composite vibrating portion configured by the vibrating portion 3*a* and the plurality of piezoelectric elements 5, thereby providing the acoustic generator 1 having preferable frequency characteristics of the sound pressure with small variation in the sound pressure.

Figure 4A:
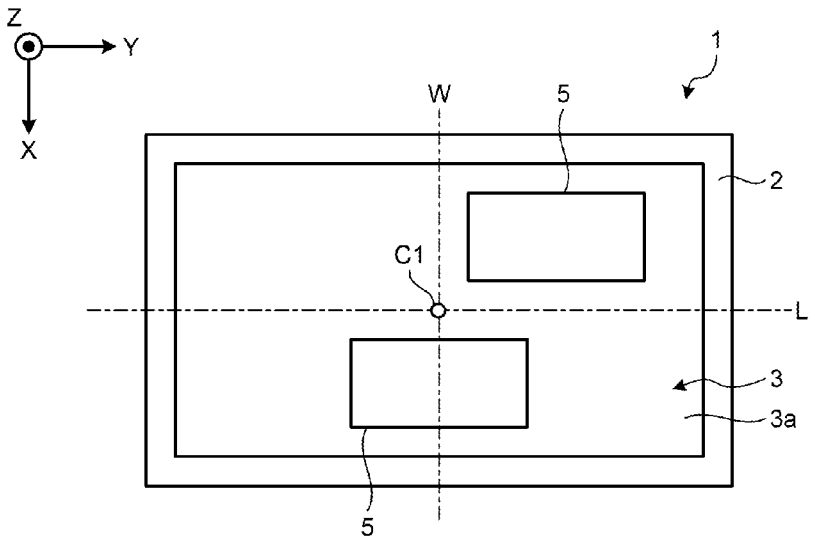
FIG. 4A is a (second) plan view schematically illustrating another example of arrangement of the piezoelectric elements.
Figure 4B:
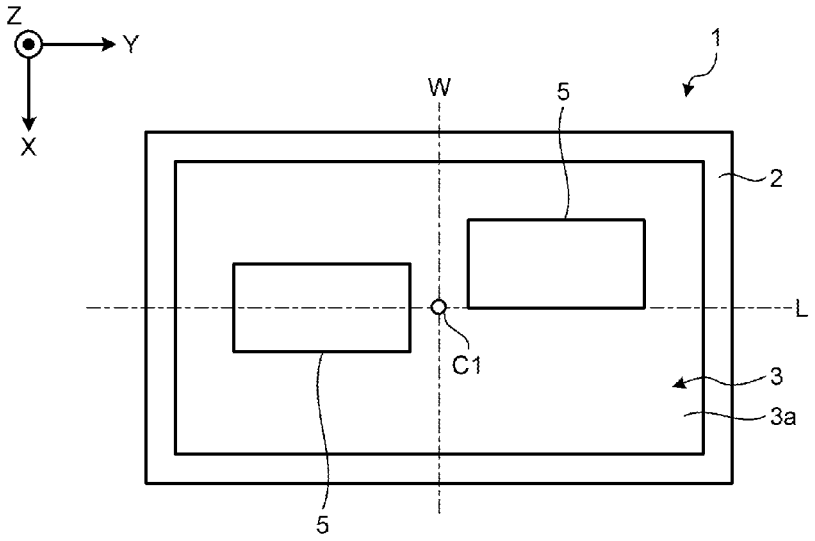
FIG. 4B is a (third) plan view schematically illustrating still another example of arrangement of the piezoelectric elements.

Subsequently, examples of arrangement as illustrated in FIG. 4A and FIG. 4B will be described. FIG. 4A and FIG. 4B are (second) and (third) plan views schematically illustrating other examples of arrangement of the piezoelectric elements 5.

In the example as illustrated in FIG. 4A, one of the two piezoelectric elements 5 is arranged at the center in the lengthwise direction and the other of the two piezoelectric elements 5 is arranged at a position different from the center in the lengthwise direction. Thus, the two piezoelectric elements 5 are attached to the vibrating portion 3*a* asymmetrically with respect to the two symmetry axes L and W and the centroid C1 of the figure drawn by the contour of the vibrating portion 3*a* when seen from the above. This arrangement of the piezoelectric elements 5 can also lower symmetric property of the composite vibrating portion configured by the vibrating portion 3*a* and the plurality of piezoelectric elements 5.

In the example as illustrated in FIG. 4B, one of the two piezoelectric elements 5 is arranged at the center in the width direction and the other of the two piezoelectric elements 5 is arranged at a position different from the center in the width direction. Thus, the two piezoelectric elements 5 are attached to the vibrating portion 3*a* asymmetrically with respect to the two symmetry axes L and W and the centroid C1 of the figure drawn by the contour of the vibrating portion 3*a* when seen from the above. This arrangement of the piezoelectric elements 5 can also lower symmetric property of the composite vibrating portion configured by the vibrating portion 3*a* and the plurality of piezoelectric elements 5.

Figure 5A:
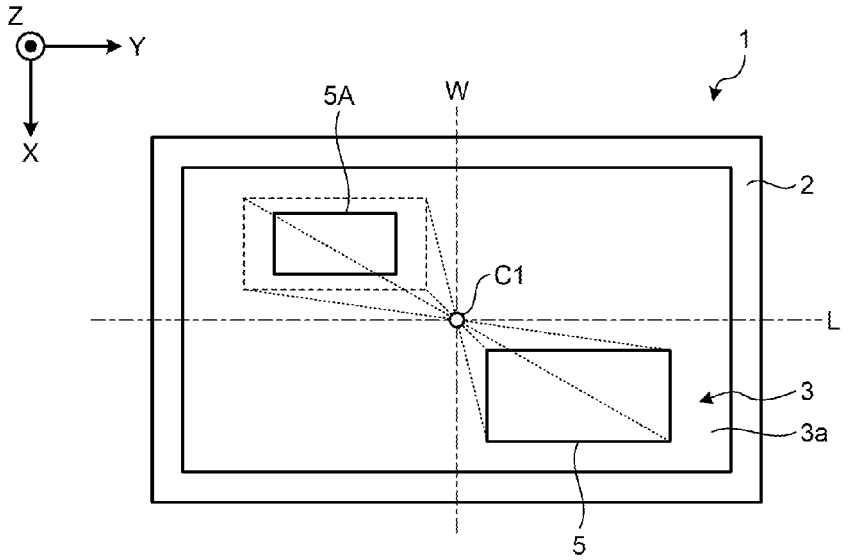
FIG. 5A is a (fourth) plan view schematically illustrating still another example of arrangement of the piezoelectric elements.
Figure 5B:
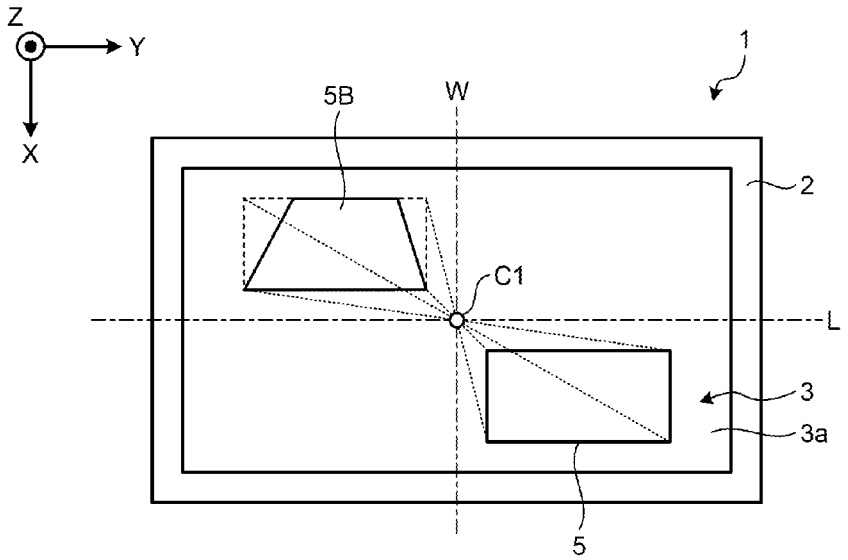
FIG. 5B is a (fifth) plan view schematically illustrating still another example of arrangement of the piezoelectric elements.

Examples of arrangement as illustrated in FIG. 5A and FIG. 5B will now be described. FIG. 5A and FIG. 5B are (fourth) and (fifth) plan views schematically illustrating other examples of arrangement of the piezoelectric elements 5.

In the example as illustrated in FIG. 5A, an area of one piezoelectric element 5A of the two piezoelectric elements 5 when seen from the above is set to be smaller than an area of the other piezoelectric element 5 when seen from the above. Thus, the two piezoelectric elements 5 are attached to the vibrating portion 3*a* asymmetrically with respect to the two symmetry axes L and W and the centroid C1 of the figure drawn by the contour of the vibrating portion 3*a* when seen from the above. This arrangement of the piezoelectric elements 5 can also lower symmetric property of the composite vibrating portion configured by the vibrating portion 3*a* and the plurality of piezoelectric elements 5.

In the example as illustrated in FIG. 5B, a shape of one piezoelectric element 5B of the two piezoelectric elements 5 when seen from the above is made different from a shape of the other piezoelectric element 5 when seen from the above. That is to say, a shape of at least one of the plurality of exciters (piezoelectric elements 5) when seen from the above is made different from a shape of the other exciter when seen from the above. Thus, the two piezoelectric elements 5 are attached to the vibrating portion 3*a* asymmetrically with respect to the two symmetry axes L and W and the centroid C1 of the figure drawn by the contour of the vibrating portion 3*a* when seen from the above. This arrangement of the piezoelectric elements 5 also lowers symmetric property of the composite vibrating portion configured by the vibrating portion 3*a* and the plurality of piezoelectric elements 5, thereby providing preferable frequency characteristics of the sound pressure.

In the example as illustrated in FIG. 5B, the shape of one piezoelectric element 5B when seen from the above is a non-isosceles trapezoidal shape and is a point-asymmetric figure. Thus, at least one of the plurality of exciters (piezoelectric elements 5) is made to have the point-asymmetric shape when seen from the above so as to lower symmetric property of the composite vibrating portion configured by the vibrating portion 3*a* and the plurality of piezoelectric elements 5, thereby providing preferable frequency characteristics of the sound pressure.

Figure 6A:
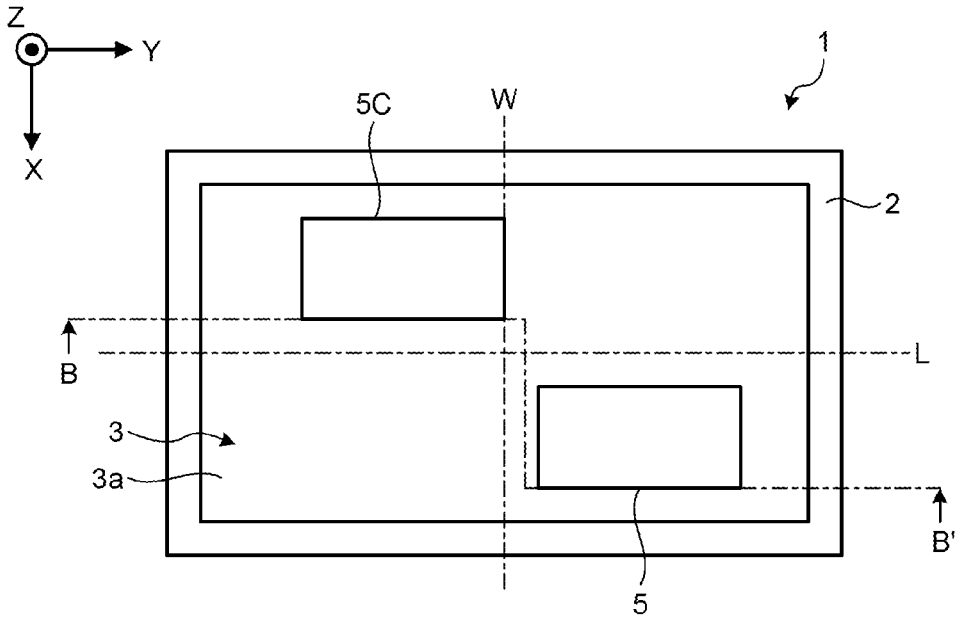
FIG. 6A is a (sixth) plan view schematically illustrating still another example of arrangement of the piezoelectric elements.
Figure 6B:
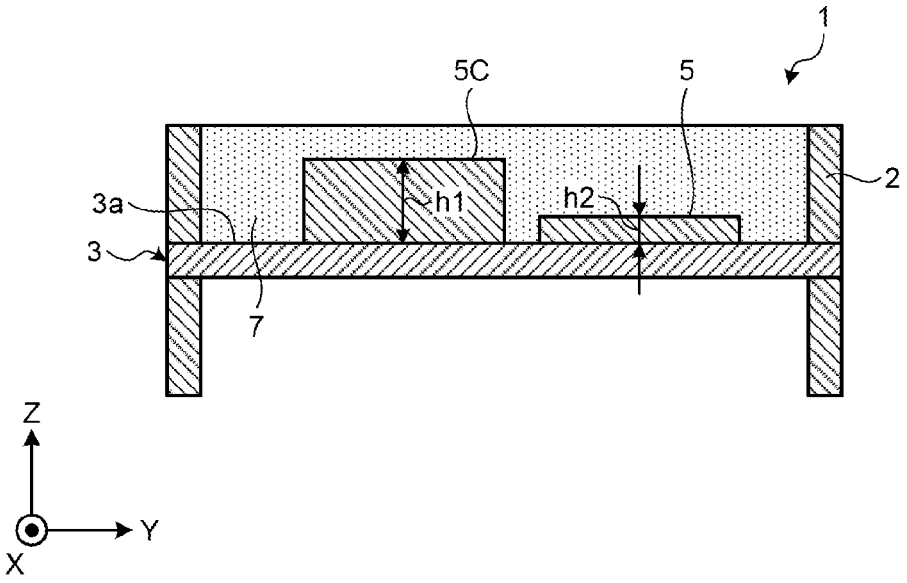
FIG. 6B is a cross-sectional view cut along line B-B' in FIG. 6A.

Subsequently, examples of arrangement as illustrated in FIG. 6A and FIG. 6B will be described. FIG. 6A is a (sixth) plan view schematically illustrating an example of arrangement of the piezoelectric elements 5 and FIG. 6B is a cross-sectional view cut along line B-B' in FIG. 6A.

In this arrangement example, as illustrated in FIG. 6B, the thickness h1 of one piezoelectric element 5C and the thickness h2 of the other piezoelectric element 5 are different. This difference causes the mass of one piezoelectric element 5C and the mass of the other piezoelectric element 5 to be different. Mass distribution of the plurality of piezoelectric elements 5 and 5C when seen from the above is asymmetry with respect to the two symmetry axes L and W. The thickness of at least one of the plurality of exciters is made different from the thickness of the other exciter such that the mass distribution of the plurality of exciters (piezoelectric elements 5 and 5C) when seen from the above is asymmetry with respect to all the symmetry axes of the figure drawn by the contour of the vibrating portion 3*a* when seen from the above. This configuration also lowers symmetric property of the composite vibrating portion configured by the vibrating portion 3*a* and the plurality of piezoelectric elements 5, thereby providing the acoustic generator 1 having preferable frequency characteristics of the sound pressure. In this case, planar arrangement of the plurality of piezoelectric elements 5 may have symmetry property.

Thus, the expression "the plurality of exciters (piezoelectric elements 5) are attached to the vibrating portion asymmetrically with respect to all the symmetry axes of the figure drawn by the contour of the vibrating portion (vibrating portion 3*a*) when seen from the above" indicates any of the following first case and second case. In the first case, the planar shape or arrangement of the plurality of exciters is asymmetry, so that the state where the plurality of exciters are attached to the vibrating portion as a two-dimensional figure is asymmetry with respect to all the symmetry axes. In the second case, the state where the plurality of exciters are attached to the vibrating portion as the two-dimensional figure is not asymmetry with respect to all the symmetry axes but the masses of the plurality of exciters are made different, so that two-dimensional mass distribution of the plurality of exciters is asymmetry with respect to all the symmetry axes.

Second Embodiment

Figure 7A:
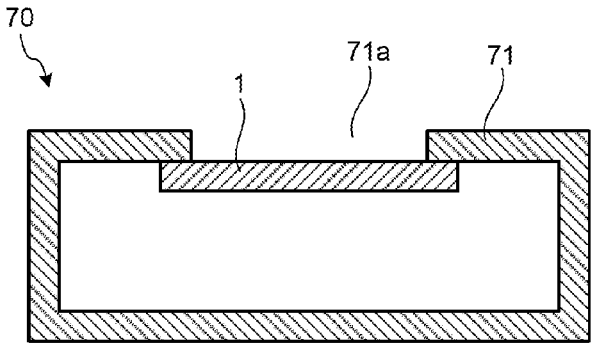
FIG. 7A is a view illustrating the configuration of an acoustic generation device according to a second embodiment.

Next, the configuration of an acoustic generation device 70 according to a second embodiment will be described. FIG. 7A is a view illustrating an example of the configuration of the acoustic generation device 70 including the acoustic generator 1 according to the above-mentioned first embodiment. In FIG. 7A, only constituent components necessary for explanation are illustrated and the detail configuration and common constituent components of the acoustic generator 1 are not illustrated.

The acoustic generation device 70 in the embodiment is an acoustic generation device such as a what-is-called speaker. As illustrated in FIG. 7A, for example, the acoustic generation device 70 includes a housing 71 and the acoustic generator 1 attached to the housing 71. The housing 71 has a box-like shape of rectangular parallelepiped and has an opening 71*a* on one surface. For example, the housing 71 can be made of a known material such as plastic, metal, and wood. The housing 71 is not limited to have the box-like shape of rectangular parallelepiped and may have various shapes such as a circular cylindrical shape and a frustum shape.

The acoustic generator 1 is attached to the opening 71*a* of the housing 71. The acoustic generator 1 corresponds to the acoustic generator in the above-mentioned first embodiment and description of the acoustic generator 1 is omitted. The acoustic generation device 70 having the configuration generates sound using the acoustic generator 1 generating high-quality sound, thereby generating high-quality sound. The acoustic generation device 70 can resonate the sound generated from the acoustic generator 1 in the housing 71 so as to increase the sound pressure in a low-frequency band, for example. A place at which the acoustic generator 1 is attached can be set freely. The acoustic generator 1 may be attached to the housing 71 through another member.

Third Embodiment

Figure 7B:
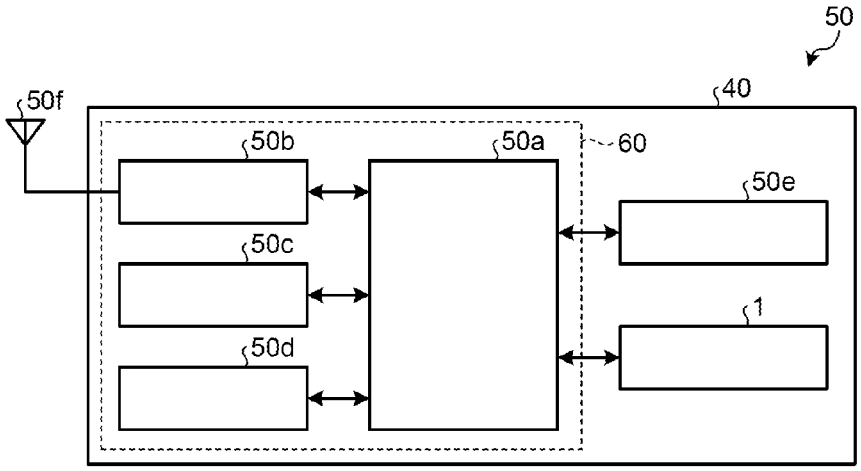
FIG. 7B is a view illustrating the configuration of an electronic device according to a third embodiment.

Next, the configuration of an electronic device according to a third embodiment will be described. FIG. 7B is a view illustrating an example of the configuration of an electronic device 50 including the acoustic generator 1 in the above-mentioned first embodiment. In FIG. 7B, only constituent components necessary for explanation are illustrated and the detail configuration and common constituent components of the acoustic generator 1 are not illustrated.

As illustrated in FIG. 7B, the electronic device 50 includes an electronic circuit 60. The electronic circuit 60 is configured by a controller 50*a*, a communication unit 50*b*, a key input unit 50*c*, and a microphone input unit 50*d*, for example. The electronic circuit 60 is connected to the acoustic generator 1 and has a function of outputting an audio signal to the acoustic generator 1. The acoustic generator 1 generates sound based on the audio signal input from the electronic circuit.

The electronic device 50 includes a display unit 50*e*, an antenna 50*f*, and the acoustic generator 1. The electronic device 50 includes a case 40 accommodating therein these respective devices.

FIG. 7B illustrates a state where all the respective devices including the controller 50*a* are accommodated in the one case 40 but does not limit an accommodation form of the respective devices. In the embodiment, it is sufficient that at least the electronic circuit 60 and the acoustic generator 1 are accommodated in the one case 40.

The controller 50*a* is a controller of the electronic device 50. The communication unit 50*b* exchanges data, for example, via the antenna 50*f*, based on the control of the controller 50*a*.

The key input unit 50*c* is an input device of the electronic device 50 and receives a key input operation by an operator. The microphone input unit 50*d* is also an input device of the electronic device 50 and receives an audio input operation by the operator.

The display unit 50*e* is a display output device of the electronic device 50 and outputs display information based on control by the controller 50*a*.

The acoustic generator 1 operates as an acoustic output device in the electronic device 50. The acoustic generator 1 is connected to the controller 50*a* of the electronic circuit 60 and receives application of a voltage controlled by the controller 50*a* so as to generate sound.

Although description is made while the electronic device 50 is a mobile terminal device in FIG. 7B, the electronic device 50 may be various electronic devices having a function of generating sound. For example, the electronic device 50 may be used for not only televisions and audio devices but also other electric products having the function of generating sound. Examples of the electric products for which the electronic device 50 may be used include vacuum, cleaners, washing machines, refrigerators, and microwaves.

Modifications

The invention is not limited to the above-mentioned embodiments and various changes or improvements can be made in a range without departing from a concept of the invention.

Although the figure drawn by the contour of the vibrating portion 3*a* when seen from the above is rectangular in the above-mentioned embodiment, for example, the shape of the figure is not limited thereto. For example, the figure may have various shapes having a symmetry axis, such as an isosceles triangle, an n-sided regular polygon (n is a positive number of equal to or more than 3), a rhombic shape, an isosceles trapezoid, a fan-like shape, an elliptic shape, and a circle.

Although the resin layer 7 is formed in the frame of the frame 2 so as to embed therein the piezoelectric elements 5 in the above-mentioned embodiment, the resin layer is not necessarily formed.

Although the supporting body supporting the vibrating portion 3*a* is the frame 2 and the frame 2 supports the peripheral edge of the vibrating portion 3*a* in the above-mentioned embodiment, the supporting manner is not limited thereto and it may support only both the ends of the vibrating portion 3*a* in the lengthwise direction or the short-side direction.

Although the exciters are bimorph-type piezoelectric elements 5 in the above-mentioned embodiment, the exciters are not limited thereto. For example, the same effects can be provided even by using unimorph-type piezoelectric elements each of which is configured by bonding a plate made of metal or the like to one main surface of the piezoelectric element that vibrates to expand and contract in the plane direction, instead of the bimorph-type piezoelectric elements. Alternatively, the piezoelectric elements that vibrate to expand and contract in the plane direction may be provided on both the surfaces of the vibrating plate 3, that is, the unimorph-type or bimorph-type piezoelectric elements may be provided on both the surfaces of the vibrating plate 3.

The exciter is not limited to the piezoelectric element and it is sufficient that the exciter has a function of vibrating upon reception of input of an electric signal. For example, the exciter may be an electrodynamics exciter, an electrostatic exciter, and an electromagnetic exciter that have been well-known as the exciters vibrating a speaker. The electrodynamic exciter vibrates a coil arranged between magnetic poles of a permanent magnet by applying an electric current to the coil. The electrostatic exciter vibrates two opposing metal plates by applying a bias and an electric signal to the metal plates. The electromagnetic exciter vibrates a thin iron plate by applying an electric signal to a coil.

Although the plurality of exciters (piezoelectric elements 5) are attached to the vibrating portion 3*a* asymmetrically with respect to all the symmetry axes of the figure drawn by the contour of the vibrating portion 3*a* when seen from the above and asymmetrically with respect to the centroid of the figure drawn by the contour of the vibrating portion 3*a* when seen from the above in the above-mentioned embodiment, the attachment manner is not limited thereto. Even when the plurality of exciters (piezoelectric elements 5) are attached to the vibrating portion 3*a* symmetrically with respect to the centroid of the figure drawn by the contour of the vibrating portion 3*a* when seen from the above, the effects can be provided only by attaching the plurality of exciters (piezoelectric elements 5) asymmetrically with respect to all the symmetry axes of the figure drawn by the contour of the vibrating portion 3*a* when seen from the above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents. It is needless to say that the invention can be applied to an acoustic generation device generating sound having a frequency higher than that of audible sound.

The invention claimed is:

1. An acoustic generator comprising at least:

a plurality of piezoelectric elements including a plurality of piezoelectric layers and electrode layers, and configured to vibrate upon reception of an input of an electric signal; and a vibrating portion to which the piezoelectric elements are attached, wherein the piezoelectric elements are two elements that have a same planar shape and a same size, the piezoelectric elements are attached to the vibrating portion asymmetrically with respect to all symmetry axes of a figure of a contour of the vibrating portion when seen from above, a centroid of the vibrating portion is located between the two piezoelectric elements, and a center of symmetry of a plane figure formed by the two elements is deviated from a centroid of the vibrating portion, and a thickness of at least one of the piezoelectric elements is different from thicknesses of the other piezoelectric elements such that mass distribution of the piezoelectric elements when seen from the above is asymmetric with respect to all the symmetry axes.

2. The acoustic generator according to claim 1, wherein the piezoelectric elements are attached to the vibrating portion asymmetrically with respect to a centroid of the figure drawn by the contour of the vibrating portion when seen from the above.

3. The acoustic generator according to claim 1, wherein at least one of the piezoelectric elements has a point-asymmetric shape when seen from the above.

4. An acoustic generation device comprising:

a housing; and the acoustic generator according to claim 1 that is provided on the housing.

5. An electronic device comprising:

a case;

the acoustic generator according to claim 1 that is provided on the case; and an electronic circuit connected to the acoustic generator, wherein the electronic device has a function of generating sound from the acoustic generator.

6. An acoustic generator comprising at least:

a plurality of piezoelectric elements including a plurality of piezoelectric layers and electrode layers; and a vibrating portion to which the piezoelectric elements are attached, wherein the piezoelectric elements are two elements that have a same planar shape and a same size, the piezoelectric elements attached to the vibrating portion asymmetrically with respect to all symmetry axes of a shape of an outline of the vibrating portion when viewed in a plan view, a centroid of the vibrating portion is located between the two piezoelectric elements, and a center of symmetry of a plane figure formed by the two elements is deviated from a centroid of the vibrating portion, and a thickness of at least one of the piezoelectric elements is different from thicknesses of the other piezoelectric elements such that mass distribution of the piezoelectric elements when seen from the above is asymmetric with respect to all the symmetry axes.

7. The acoustic generator according to claim 6, wherein the piezoelectric elements are attached to the vibrating portion asymmetrically with respect to a centroid of a shape of an outline of the vibrating portion when viewed in a plan view.

8. The acoustic generator according to claim 6, wherein at least one of the piezoelectric elements has a point-asymmetric shape when viewed in a plan view.

9. The acoustic generator according to claim 7, wherein at least one of the piezoelectric elements has a point-asymmetric shape when viewed in a plan view.

10. An acoustic generation device comprising:

a housing; and the acoustic generator according to claim 6 that is provided on the housing.

11. An electronic device comprising:

a case;

the acoustic generator according to claim 6 that is provided on the case; and an electronic circuit connected to the acoustic generator.

12. An electronic device comprising:

a case;

the acoustic generator according to claim 7 that is provided on the case; and an electronic circuit connected to the acoustic generator.

13. An electronic device comprising:

a case;

the acoustic generator according to claim 8 that is provided on the case; and an electronic circuit connected to the acoustic generator.

* * * * *